US010047322B2

(12) United States Patent
Leipold et al.

(10) Patent No.: US 10,047,322 B2
(45) Date of Patent: Aug. 14, 2018

(54) AGENT FOR REMOVING STAINS AND DEPOSITS COMPRISING AN ALKYLENE STYRENE COPOLYMER

(71) Applicant: GETing solutions GmbH, Herrenberg (DE)

(72) Inventors: Joachim Leipold, Reutlingen (DE); Edgar Jaeschke, Filderstadt (DE); Antje Schirmer, Rottenburg a.N. (DE)

(73) Assignee: BUCK SERVICE GMBH, Herrenberg (DE)

( * ) Notice: Subject to any disclaimer, the term of this patent is extended or adjusted under 35 U.S.C. 154(b) by 19 days.

(21) Appl. No.: 14/899,983

(22) PCT Filed: Jun. 18, 2014

(86) PCT No.: PCT/EP2014/062799
§ 371 (c)(1),
(2) Date: Dec. 18, 2015

(87) PCT Pub. No.: WO2014/202651
PCT Pub. Date: Dec. 24, 2014

(65) Prior Publication Data

US 2016/0137955 A1 May 19, 2016

(30) Foreign Application Priority Data

Jun. 18, 2013 (DE) ..... 10 2013 106 363

(51) Int. Cl.

| | |
|---|---|
| ***C11D 3/37*** | (2006.01) |
| ***C11D 3/395*** | (2006.01) |
| ***C11D 3/04*** | (2006.01) |
| ***C11D 3/18*** | (2006.01) |
| ***C11D 3/20*** | (2006.01) |
| ***C11D 3/39*** | (2006.01) |
| ***C11D 3/43*** | (2006.01) |
| ***C11D 3/48*** | (2006.01) |
| ***C11D 11/00*** | (2006.01) |
| ***C11D 1/28*** | (2006.01) |
| ***C11D 1/83*** | (2006.01) |
| ***C11D 17/00*** | (2006.01) |

(52) U.S. Cl.
CPC ..... *C11D 3/3746* (2013.01); *C11D 1/28* (2013.01); *C11D 1/83* (2013.01); *C11D 3/042* (2013.01); *C11D 3/044* (2013.01); *C11D 3/18* (2013.01); *C11D 3/2075* (2013.01); *C11D 3/3749* (2013.01); *C11D 3/395* (2013.01); *C11D 3/3947* (2013.01); *C11D 3/43* (2013.01); *C11D 3/48* (2013.01); *C11D 11/0017* (2013.01); *C11D 11/0023* (2013.01); *C11D 17/003* (2013.01)

(58) Field of Classification Search
CPC ..... C11D 3/042; C11D 3/044; C11D 3/37; C11D 3/395; C11D 3/3955; C11D 9/446; C11D 11/0017; C11D 11/0023; C11D 17/003; C11D 17/043
See application file for complete search history.

(56) References Cited

U.S. PATENT DOCUMENTS

| | | | | |
|---|---|---|---|---|
| 4,931,207 | A | 6/1990 | Cramer et al. | |
| 4,968,447 | A | 11/1990 | Dixon et al. | |
| 5,205,960 | A | 4/1993 | Kristopeit et al. | |
| 5,449,473 | A | 9/1995 | Bunczk et al. | |
| 5,965,512 | A | 10/1999 | Smyth et al. | |
| 7,214,652 | B1 | 5/2007 | Jariwala | |
| 7,288,507 | B2 | 10/2007 | McGee et al. | |
| 2003/0083208 | A1 | 5/2003 | Swanson et al. | |
| 2004/0229981 | A1 | 11/2004 | Petri | |
| 2005/0087216 | A1 | 4/2005 | Dudjak | |
| 2005/0143268 | A1* | 6/2005 | Midha | A61K 8/0237 510/130 |
| 2005/0238601 | A1* | 10/2005 | Cheng | A61K 8/361 424/70.11 |
| 2006/0025325 | A1 | 2/2006 | Ryther | |
| 2008/0045428 | A1* | 2/2008 | Focht | A61K 8/02 510/158 |
| 2010/0300493 | A1 | 12/2010 | Snodgrass et al. | |
| 2011/0089073 | A1* | 4/2011 | Baig | A61K 8/24 206/524.1 |
| 2011/0117225 | A1* | 5/2011 | Wei | A61K 8/044 424/757 |
| 2011/0121033 | A1* | 5/2011 | Horne | A61K 8/368 222/145.1 |

FOREIGN PATENT DOCUMENTS

| | | | |
|---|---|---|---|
| DE | 4310136 | A1 | 10/1994 |
| DE | 19935259 | A1 | 2/2001 |
| DE | 102007014875 | A1 | 10/2008 |
| EP | 0786514 | A2 | 7/1997 |
| EP | 1238050 | B1 | 3/2005 |
| EP | 2275524 | B1 | 10/2011 |
| GB | 672232 | A | 5/1952 |
| WO | 03066797 | A1 | 8/2003 |
| WO | 2009085049 | A1 | 7/2009 |
| WO | 2009106220 | A1 | 9/2009 |
| WO | 2011077144 | A1 | 6/2011 |

* cited by examiner

*Primary Examiner* — Charles Boyer
(74) *Attorney, Agent, or Firm* — Kriegsman & Kriegsman

(57) ABSTRACT

Agent for removing spots or deposits from hard or soft surfaces. The agent includes surfactants, an adhesion promoter, and at least one active substance, wherein the adhesion promoter is selected from the group of the alkylene-styrene copolymers, the olefin homopolymers or olefin copolymers of two or more olefins, wherein the polymers can also be hydrogenated, and the polyalkylene derivatives, the active substance is an acid, an alkali, a bleaching agent, and/or hydrophobic organic solvent not bound in a gel, and the agent includes either at least 10 wt % of at least one acid or at least 10 wt % of at least one alkali and/or at least 5 wt % of a bleaching agent and/or includes at least 10 wt % of hydrophobic organic solvent not bound in a gel.

19 Claims, 6 Drawing Sheets

Starting material

Stain remover according to the invention

Beckmann's Stain Devil (thoroughly wetted)

Starting material

Stain remover according to the invention

Dr. Beckmann's "Lubricants/ oils" Stain Devil

Starting material

Stain remover according to the invention

Dr. Beckmann's "Grease & sauces" Stain Devil

Starting material

Stain remover according to the invention

Dr. Beckmann's "Fruit & drinks" Stain Devil

Starting material

Stain remover according to the invention

Dr. Beckmann's "Nature & beauty" Stain Devil

Starting material

Stain remover according to the invention

Dr. Beckmann's "Grease & sauces" Stain Devil

AGENT FOR REMOVING STAINS AND DEPOSITS COMPRISING AN ALKYLENE STYRENE COPOLYMER

BACKGROUND OF THE INVENTION

The present invention relates to agents which are suitable for removing a large number of different stains and deposits on hard and soft surfaces.

In particular, the agent is suitable for removing difficult-to-remove stains from soft, sensitive materials such as textiles. The stains may be stains in the armpit area of items of clothing, but also stains made of chocolate, lipstick, shoe cream, red wine, turmeric, grease, lime, soap residues, feces, rust, blood and chewing gum.

Moreover, the agent according to the invention is also suitable for removing stains or deposits from hard surfaces. In particular, the agent according to the invention can also be used industrially for the removal of deposits, for example of flue gas resin in boiler plants and combustion chambers. In a further variant, the agent according to the invention can also be used to strip contaminants on semiconductor surfaces. Use in etching processes is also possible. A further field of use is the removal of moss.

The prior art discloses various stain removers for stains made of chocolate, lipstick, shoe cream, red wine, turmeric, grease, lime, soap residues, feces, rust and blood. Moreover, there are various household products that are used for removing such stains.

However, with the agents known hitherto, either adequate removal of stubborn stains, such as, for example, of cocoa, lipstick or turmeric, is not possible, or the fabric exhibits damage following application of the agent.

A further problem in the removal of stains, for which no satisfactory solution that is gentle to the fabric has hitherto been found, is the removal of stains in the armpit area of textiles. Such stains are to be attributed to the formation of sparingly soluble deposits which partially harden. It is assumed that these deposits are reaction products of perspiration, aluminum chlorohydrates present in the deodorants and the metabolic products of bacteria. No suitable agent that is gentle to the fabric is known to date for the complete removal of such stains.

Agents for cleaning sanitary objects such as toilet bowls which can be applied directly to a sanitary object such as a toilet, adhere there and can be flushed away only after a relatively large number of flushing operations and which are so sticky that further agents can be attached thereto are known from EP 2 275 524 B1. These agents serve for maintenance cleaning and not for the one-off removal of stains or contaminants.

Acidic agents which supposedly serve in particular for the removal of stains on textiles in the armpit area are known from WO 2011/077144 A1. These agents are strongly acidic (pH<1) and comprise water and a surfactant as well as an acid. If desired, the agent can also be thickened with a gel former or a thickener such as, for example, ethoxylated fatty alcohols/ethoxylated fatty amines.

In practice, however, it is found that such agents either do not permit adequate removal of the stains in the armpit area of the textiles, or else do remove the stains but at the same time damage the textiles.

Acid-comprising agents for cleaning hard surfaces are known from WO 2009/085049. The agents therein comprise an organic acid, nonionic surfactants, water and a hydrophilic polymer which adsorbs to the hard surface. As hydrophilic polymers, which also adsorb to the hard surface, this document teaches the use of polybetaines.

Agents for removing stains from textiles which comprise lightly colored crystalline clay minerals are known from EP 1 238 050 B1. WO 03/066797 teaches a stain cleaner which comprises, inter alia, a hydrophobic component.

EP 0 786 514 A2 discloses a stain remover which comprises nonionic surfactants, anionic soaps and a polymer.

DE 199 35 259 A1 discloses a bleach composition which can be used as pre- or post-treatment agent for textiles.

DE 10 2007 014 875 A1 teaches a liquid cleaner which comprises photocatalytic material, humectants and surfactants.

SUMMARY OF THE INVENTION

The object of the invention consists in indicating an agent which is suitable for the effective removal of stains and deposits on textiles, in particular in the armpit area, and for removing the above "stubborn" stains and for which simultaneously the surface to be treated is not damaged very much or at all.

It is a further object to provide an agent which is also suitable for the removal of deposits and stains on hard surfaces and in particular for the removal of deposits containing resin, grease or oil, including on an industrial scale, and of moss.

These objects are achieved by an agent for removing stains or deposits from hard or soft surfaces, which agent comprises surfactants, an adhesion promoter and at least one active substance, where the adhesion promoter is selected from the group of the alkylene styrene copolymers, the olefin homopolymers or olefin copolymers of two or more olefins, where the polymers may also be hydrogenated, and the polyalkylene derivatives, the active substance is an acid, an alkali, a bleach and/or hydrophobic organic solvent not bonded in a gel, and the agent comprises either at least 10% by weight of at least one acid or at least 10% by weight of at least one alkali and/or at least 5% by weight of a bleach, and/or comprises at least 10% by weight of hydrophobic organic solvent not bonded in a gel. These objects are also achieved by an agent for removing moss, where the agent comprises surfactants, an adhesion promoter and at least one active substance, where the adhesion promoter is selected from the group of the alkylene styrene copolymers, the olefin homopolymers or olefin copolymers of two or more olefins, where the polymers can also be hydrogenated, and the polyalkylene derivatives, the active substance is at least 5% of an acid and/or at least 1% of a biocide.

DETAILED DESCRIPTION OF THE INVENTION

Figure 1A:
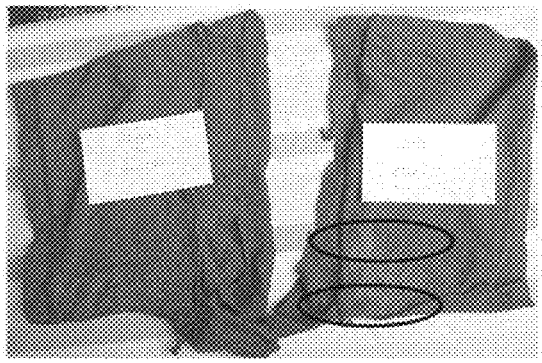
FIGS. 1(*a*) through 1(*c*) are photos, as discussed in Example III, showing a starting material with stains in the armpit area, the result after treating such a stain with an agent according to the invention, and the result after treating such a stain with Dr. Beckmann's Stain Devil, respectively.

Surprisingly, it has been established that a both effective and also gentle stain removal can be achieved even on sensitive surfaces if the agent comprises, besides the respective active substances such as acids, alkalis, bleaches and/or organic hydrophobic solvents not bonded in a gel, also surfactants and an adhesion promoter, where the adhesion promoter is selected from the group of the alkylene styrene copolymers, the olefin homopolymers or olefin copolymers of two or more olefins, where the polymers may also be hydrogenated, and the polyalkylene derivatives.

Here, the "active substances" generally bring about the actual stain removal.

The adhesion promoters serve to make the agent sticky so that, following application to the stain in question or the deposit, the agent sticks and does not run off or drip off.

The surfactants present in the agent bring about, on the one hand, a cleaning effect. Moreover, they contribute to the hydrophobic adhesion promoter dissolving in the presence of water.

The adhesion promoter, which is generally hydrophobic, moreover brings about a protection and delay effect. Water-soluble active ingredients are only released from the agent in the presence of water. Before that, reactive active ingredients are protected in the hydrophobic matrix.

This extends the effectiveness time of the agent. Moreover, reactive active ingredients can also be formulated in the hydrophobic matrix without losing the effect even within a short time.

Depending on the active ingredient added, the agent can be formulated for removing a very wide variety of stains or deposits.

In a first variant, the agent comprises, besides surfactants and the adhesion promoter, at least 10% by weight of acid as active ingredient. Such an agent can be used for removing acid-soluble stains.

Surprisingly, it has been found that such an acidic stain remover, in particular with alkylene styrene copolymers dissolved in hydrophobic solvents as adhesion promoter, surfactants and at least 10% by weight, preferably at least 15% by weight and particularly preferably at least 20% by weight of acid, is superior over conventional agents for removing stains from textiles in the armpit area. The stain can be effectively removed with the agent according to the invention without damaging the fabric.

Moreover, it is possible to use such acid-adjusted agent for the removal of stains such as rust, blood or contaminants on top of calcifications. Since the acid-adjusted agent does not attack the fibers, such an agent is suitable for the removal of stains and deposits in particular on soft sensitive surfaces such as woven, knitted or fulled fabrics, especially on textiles, carpets or curtains. The surfaces can be e.g. made of synthetic or natural fibers, natural or artificial leather or else of plastic.

Moreover, the acid-adjusted agent according to the invention can of course also be used to remove such stains from hard, insensitive surfaces, for example on metal, ceramic, stone, glass, plastic or wood.

In a further variant, which is suitable in particular for the removal of colored stains such as, for example, red wine, the agent comprises bleaches as active ingredient, for example salts of peracids such as perborates, percarbonates, persulfates or phthalimidoperoxohexanoic acid (PAP). Preferably, the bleaches are present in a concentration of at least 5% by weight and preferably of at least 8% by weight and particularly preferably at least 12% by weight, in the agent. If desired, a bleach activator such as, for example, tetraacetyleneethylenediamine (TAED), nitrile quats, NOBS (nonanoyloxobenzenesulfonate) or DOBS (decanoyloxobenzenesulfonate), can also be added to the agent.

In a preferred variant, the bleach-comprising agent comprises at least 20% by weight of surfactants, at least 10% by weight of bleaches and between 20% by weight and 60% by weight of adhesion promoters as pure substance or as a solution in a hydrophobic solvent and optionally bleach activators and solubility promoters, in a particularly preferred embodiment between 25% by weight and 40% by weight of surfactants, at least 10% by weight of salts of peroxo acids and between 30% by weight and 50% by weight of adhesion promoters, in particular alkylene styrene copolymers dissolved in hydrophobic solvents (Versagel).

Such agents are suitable for the removal of red wine, coffee or tea stains from soft sensitive surfaces such as textiles and carpets, but also for the removal of red wine, coffee or tea stains from the aforementioned hard surfaces.

For this, the agent is applied to the stain on the affected article, if necessary waiting or action times are observed, and the article is then washed, for example in a washing machine or else rinsed. In the presence of the water, the bleaches and the surfactants are then gradually released from the agent on the stain and bleach the stain and transport the contaminants away into the wash liquor. Since the active ingredients are incorporated in the hydrophobic matrix of the adhesion promoter and are only dissolved from this in the presence of water, overdoses of the active ingredients and therefore damage to the fabric can be avoided.

In a further variant, the agent according to the invention can be formulated for the removal of fat-soluble and/or pigment-containing contaminants such as lipstick, shoe cream, cocoa, greases or waxes.

To remove such contaminants, the agent has firstly hydrophobic organic solvents, which serve to dissolve the greases or waxes. The hydrophobic organic solvents which serve for this purpose must therefore be freely available in the agent. Solvents which are present in the agent but which are required for the gel formation, such as, for example, the hydrophobic solvents, which function as solvents for the gel formation in the Versagel particularly preferred as adhesion promoter are not freely available organic solvents in the context of the invention.

Preferably, therefore, hydrophobic organic solvents are additionally added to the agent via the hydrophobic solvent required for the gel formation, for example terpenes, alkanes, mineral oils, long-chain alcohols (R>10), esters or ethers.

In general, the concentration of the free organic solvents in the agent is at least 10% by weight, preferably above 15% by weight and particularly preferably between 20% by weight and 40% by weight.

In addition to the freely available organic hydrophobic solvents, the agent should also have alkalis which, on the one hand, likewise serve to dissolve the greases and oils. On the other hand, the alkalis also bring about a swelling of the fibers and thus also facilitate the active ingredients penetrating sufficiently into the textiles and being able to transport away again dissolved contaminants as a consequence of the swollen structure.

The concentration of alkalis in those agents which additionally comprise hydrophobic organic solvents is generally at least 2% by weight and preferably at least 5% by weight.

Such alkaline-adjusted agents with at least 2% by weight of alkalis, preferably NaOH or KOH, at least 20% by weight of free hydrophobic organic solvents, preferably terpenes, at least 10% by weight of adhesion promoters (preferably alkylene styrene copolymer, dissolved in organic solvents such as Versagel) and at least 20% by weight of surfactants are suitable for removing grease- and/or pigment-containing stains such as cocoa, lipstick, shoe cream, chewing gum and turmeric, preferably from soft, sensitive, in particular textile surfaces.

Such an agent can of course also be used for removing stains from hard surfaces.

In a further variant, the agent is formulated with a very high fraction of alkalis, which is generally above 50% by weight and preferably above 60% by weight. Such adhesive, pasty, strongly alkaline agents stick to vertical surfaces and release the alkalis in the presence of water, for example as a result of flushing, and these then attack deposits of resins, greases, oils or the like. Such agents can be used for example in industrial plants and combustion chambers in order to remove flue gas resins, grease- or oil-containing contaminants or soot. Such a strongly alkaline agent exhibits very good results when removing resin or grease deposits even on vertical surfaces (e.g. in slaughter-houses, in pipe blockages of greases (drain-opener), for the removal of keratin substances (hair, horn)). For the cleaning of sensitive soft surfaces, by contrast, such a strongly alkaline agent is only suitable in exceptional cases, e.g. for fabric made of alkali-resistant fibers such as Teflon or PUR.

Surfactants

The agent according to the invention comprises surfactants, where anionic, cationic, nonionic and amphoteric surfactants can be used as surfactants.

The surfactants serve in the agents according to the invention not only for cleaning, but also enable the polymer adhering to the surface to be rinsed off again. Moreover, surfactants have a thickening effect on the polymers, i.e. by adding surfactants, particularly in powder form, it is also possible to adjust the viscosity of the agent.

Surfactants which can be used are in principle all known anionic and/or cationic and/or nonionic and/or amphoteric surfactants, with pulverulent to highly pasty ones being preferred.

The surfactant fraction in the agent can be up to 80% by weight, preferably 10% by weight to 60% by weight and particularly preferably 25% by weight to 45% by weight.

The anionic surfactants take on several functions in the present invention. Firstly, they serve to emulsify the polymeric matrix without completely destroying the adhesiveness.

Secondly, they make an essential contribution to the plastification of the starting polymer by serving as viscosity increaser (thickener). Last but not least, a good cleaning effect of the surfactants is desired, which is assisted by the good wetting properties.

The anionic surfactants used are preferably one or more substances from the group of the salts of the carboxylic acids, the sulfuric acid half-esters and the sulfonic acids, preferably from the group of the fatty acids, the fatty alkyl sulfuric acids and the alkylaryl sulfonic acids. Usually, the C-chain distributions of the anionic surfactants are in the range from 6 to 40, preferably 8 to 30 and in particular 12 to 22 carbon atoms.

Carboxylic acids (C6-C22) in the form of their metal salts (preferably alkali metal salts) and their natural or synthetic mixtures, and also alkali metal salts of the sulfuric acid half-esters and longer-chain alcohols can likewise be used as anionic surfactants.

A further class of anionic surfactants which can be used according to the invention are the alkali metal salts of the alkyl ether sulfuric acids. Alkyl ether sulfuric acids are synthesized like the alkyl sulfuric acids from fatty alcohols, which are reacted with ethylene oxide to give the fatty alcohol ethoxylates in question. Instead of ethylene oxide, it is also possible to use propylene oxide. The subsequent sulfonation produces the alkyl ether sulfuric acids in question.

In the context of the present invention, it is also possible to use the alkali metal salts of the alkane sulfonic acids and olefin sulfonic acids as anionic surfactants. Alkane sulfonic acids can comprise the sulfonic acid group terminally bonded (primary alkane sulfonic acids) or along the C chain (secondary alkane sulfonic acids). Typical representatives are alkyl benzene sulfonates, particularly preferably linear alkyl benzene sulfonates (LAS).

The aforementioned anionic surfactants can be used in their neutralized form on their own or in a mixture with one another.

According to the invention, the surfactant phase comprises, based on its weight, preferably 10% by weight to 90% by weight and particularly preferably 40% by weight to 85% by weight of lauryl sulfate.

Nonionic surfactants that can be used are alkoxylated, preferably ethoxylated, in particular primary alcohols having preferably 8 to 18 carbon atoms and on average 1 to 12 mol of ethylene oxide (EO) per mol of alcohol, in which the alcohol radical can be linear or preferably methyl-branched in the two-position and/or can comprise linear and methyl-branched radicals in a mixture, as are customarily present on oxoalcohol radicals. In particular, however, preference is given to alcohol ethoxylates with linear radicals from alcohols of native origin having 12 to 18 carbon atoms, e.g. from coconut, palm, tallow fatty or oleyl alcohol and on average 2 to 8 EO per mol of alcohol. In addition to these nonionic surfactants, fatty alcohols with more than 12 EO can also be used. Examples thereof are tallow fatty alcohols having 14 EO, 25 EO, 30 EO or 40 EO.

Moreover, further nonionic surfactants which can be used are also alkyl glycosides of the general formula alkyl-O(G), where alkyl is a primary straight-chain or methyl-branched, in particular methyl-branched in the two-position, aliphatic radical having 8 to 22, preferably 12 to 18 carbon atoms, and G is the symbol for a glycoside unit having 5 or 6 carbon atoms, preferably glucose.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain, in particular fatty acid methyl esters. Nonionic surfactants of the amine oxide type, for example N-cocoalkyl-N,N-dimethylamine oxide and N-tallow-alkyl-N,N-dihydroxyethylamine oxide or alkanolamides, can also be used.

The fraction of the nonionic surfactant or surfactants in the total surfactant phase can be up to 50%, preferably up to 30% and particularly preferably up to 25%.

The surfactant phase can, if desired, also be equipped with cationic or amphoteric and zwitterionic surfactants. Examples of amphoteric surfactants are fatty acid amidopropylbetaines with C5-C21 fatty acid fractions, but also amphodiacetates.

Cationic surfactants are preferably used in the present acidic formulation also as bactericidally effective substances. Zwitterionic surfactants can be described by way of example as quaternary ammonium, phosphonium or sulfonium components which are joined via an aliphatic bridge to a further now anionic group such as carboxy, sulfonate, sulfate, phosphate or phosphonate.

Foamers which can be added to the agent are also olefin sulfonates, ether sulfates or acid methyltaurides. If strong foamers are used, then preferably 1 to 50, in particular 1 to 25% of the surfactant phase can be replaced by one or more foamers, e.g. from the group of the betaines, the alkoxylated alkyl ether sulfates or lactobionic acid derivatives. These foamers can be selected from the fatty acid amidopropylbetaines with a C5-C21 fatty acid fraction such as, for example, cocoamidopropylbetaine, the alkali metal or ammonium salts of the lauryl ether sulfates with 1 to 5 EO, lactobionococoylamide, lactobionooleylamide, lactobionotallowamide etc. or mixtures thereof. These foamers can be readily incorporated into the agent according to the invention. Preference is given to using those cosurfactants which are present in solid, preferably pulverulent or highly viscous form.

Adhesion Promoters

An essential constituent of the agent according to the invention are adhesion promoters which are selected from the group of the alkylene styrene copolymers, the olefin homopolymers or olefin copolymers of two or more olefins, where the polymers may also be hydrogenated, and the polyalkylene derivatives.

The alkylene styrene copolymers selected are preferably diblock or triblock copolymers, in particular from the group of the styrene-butadiene-styrene copolymers (SBS), the styrene-isoprene-styrene copolymer (SIS), the styrene-ethylene/butylene-styrene copolymers (S-EB-S), the styrene-ethylene/propylene copolymers (S-EP), the styrene-ethylene/butylene copolymers (S-EB), the styrene-butadiene copolymers (SB) and styrene-isoprene copolymers (SI). The alkylene styrene copolymers may also be hydrogenated or partially hydrogenated. Preferably, the hydrogenated or non-hydrogenated alkylene styrene copolymers are crosslinked.

The alkylene styrene copolymers, in particular the polymers from the group of the alkylene styrene copolymers, are preferably dissolved in a solvent, in particular hydrophobic solvents such as mineral or vegetable oils, alkanes or aromatic hydrocarbons. The solvents should be aprotic and nonpolar and preferably nonreactive.

As a result of this, hydrophobic gels that are sticky are often formed. Such gels consist in general for example of 1 to 20% by weight of polymers and 80 to 99% by weight of hydrophobic solvents such as, for example, mineral oil.

Alkylene styrene copolymers are supplied for example in the form of a solution in a hydrophobic solvent by Penreco under the trade name Versagel, such as e.g. Versagel M750 or Versagel M1600. Kraton Performance Polymers supplies alkylene styrene copolymers as solid under the trade name "Kraton".

By adding the polymers—optionally dissolved in hydrophobic solvents—the agents are also sticky. The result of this is that the agent adheres to the surface of the object in question and can thus have an effect on the surface to be treated over an extended period during flushing or during the washing process.

The olefin homopolymers or copolymers that can be used are polybutadiene rubbers, styrene-butadiene block polymers and copolymers, and also the polyisopropenes, but also random (block) polymers which are obtained by 1,3-addition of butadiene or isoprene onto styrene or alpha-methyl styrene. Homopolymers or copolymers of ethylene or propylene, such as the ethylene-propylene diene terpolymers, the natural rubbers and the norbornene polymers or polydicyclopentadiene can also be used. The compounds from the group of the olefin homopolymers and copolymers can also be partially hydrogenated, partially oxidized or further functionalized via graft molecules.

A further possible class of adhesion promoters from the group of the polyalkylene derivatives comprises polyalkylene chains with randomly distributed functional groups. The polyalkylene chains are preferably polybutadiene, polyisopropylene and polypropylene chains.

The functional groups randomly distributed on the polyalkylene chains are preferably reactive groups, in particular from the group of the anhydrides, thiols, epoxides or primary amines. The functional groups are of course to be selected such that the adhesion promoters do not react with the other constituents of the agent.

Particular preference is given to polymers with maleic anhydride groups bonded randomly to the polybutadiene chain. The particularly preferred maleic anhydride adduct onto 1,4-cis-polybutadiene is available from Degussa under the name Polyvest.

Active Substance

The agent according to the invention furthermore comprises at least one active substance which is to be selected according to the stain to be removed or the deposit to be removed.

Active substances in the context of the present invention are acids, alkalis, bleaches and freely available organic hydrophobic solvents. Depending on the intended use, a plurality of active substances may also be present in the agent.

Acids as Active Substance

If the agent according to the invention comprises acids as active substance, then the agent is suitable, for example, for the removal of stains from soft surfaces such as of stains on items of clothing in the armpit area or of rust and blood stains or contaminants on top of calcifications.

Acids that can be used are organic and inorganic acids, also in combination.

Suitable organic acids are, for example, acetic acid, lactic acid, citric acid, lavulinic acid, tartaric acid, formic acid, glycolic acid, succinic acid, glutaric acid, maleic acid, methanesulfonic acid, sulfamic acid or else oxalic acid. The concentration of organic acids should be between 1% by weight and 60% by weight, preferably between 15% by weight and 40% by weight.

Inorganic acids that can be used are, for example, sulfuric acid, nitric acid, hydrochloric acid or phosphoric acid. The concentration of inorganic acids in the agent should be, in the case of an acid-adjusted agent, between 1% by weight and 40% by weight, preferably between 10% by weight and 30% by weight.

If no further active substances are present in the agent, the minimum content of acids (organic and/or inorganic) in the agent should be at least 10% by weight.

The pH of a 1% solution of the agent with an acid should be pH 2 or less, preferably at most pH 1.5 and particularly preferably at most pH 1.

Preference is given to the use of solid anhydrous acids such as sulfamic acid.

Acids and Bleaches as Active Substance

In a further variant, the agent comprises, as active substance, at least one oxidizing agent in addition to the at least one acid.

Such a variant is suitable for removing stains of rust, blood, perspiration and oxidizable substances.

For an acidic, oxidizing agent, phosphoric acid can be used with $H_2O_2$ (stabilized). The fraction of $H_2O_2$ (absolute) in the agent should preferably be between 2% by weight and 5% by weight.

Alkalis as Active Substance

To remove resin stains, for example of flue gas resins, an agent is suitable which comprises a high fraction of alkalis.

Alkalis that can be used are, for example, oxides and hydroxides of alkali metals and alkaline earth metals such as NaOH, KOH or MgO or $Na_2O$, preferably as solid or as prills.

To remove resin stains or oil-containing stains, in particular on hard surfaces, the fraction of alkalis in the agent can be 50% by weight and more, preferably at least 60% by weight and particularly preferably at least 70% by weight.

The pH of a 1% solution of an alkaline-adjusted agent should be at least pH 9, preferably at least pH 10 and particularly preferably at least pH 11.

Alkalis and Hydrophobic Solvents as Active Substance

To remove grease-containing stains such as shoe cream or chocolate, in particular from sensitive soft surfaces such as textiles, an agent is suitable which comprises, as active substance, alkalis and free hydrophobic organic solvents. The alkalis serve to swell the fibers. Alkalis and hydrophobic solvents serve to dissolve the grease-soluble contaminants and/or to chemically modify them, e.g. by ester cleavage.

Since in some variants of the agent according to the invention the adhesion promoter is gelled in a hydrophobic solvent such as a mineral oil (e.g. as Versagel 1600) and the part of the mineral oil required for the gel formation is not available as hydrophobic solvent, the dissolution of grease-soluble substances in the formulation can take place only as a result of "free" solvents, i.e. solvents not required for the gel formation.

In a preferred variant, therefore, additional hydrophobic solvents such as, for example, terpenes are added to the Versagel comprising the mineral oils required for the gel formation in the agent in a fraction—depending on the stain to be removed—of at least 10% by weight and preferably up to 40% by weight. In such an agent, the fraction of alkalis is at least 2% by weight.

The free hydrophobic solvents bring about an initial dissolution of the oil-containing soiling simply upon application of the agent to the stain.

Alkalis and Bleaches as Active Substance

In a further variant, the agent according to the invention can comprise alkalis and bleaches as active substance. In this variant, bleaches which are stable in alkaline conditions are also additionally added to the agent described above with alkalis as active substance, such as, for example, chlorine-releasing bleaches such as cyanurates or chlorine bleaches, preferably in a concentration of 0.01% by weight to 1% by weight.

Such an agent is suitable for the removal of stains from fabrics which are chlorine-stable, preferably from undyed fibers.

Moreover, the agent according to the invention can comprise solubility promoters in order to facilitate emulsification above phase limits. Solubility promoters that can be used are, for example, glycol ethers or sodium cumene sulfonate, preferably in a concentration between 1% by weight and 40% by weight.

Furthermore, the agent according to the invention can also comprise humectants. Preference is given to using polyalcohols such as e.g. glycerol or glycol.

Furthermore, (co)-thickeners can be added to the agent according to the invention in order to increase the plasticity of the agent. (Co)-thickeners which can be used are, for example, bentonites, powder surfactants, xanthans, polybutadiene rubbers, polyisopropenes, block copolymers which comprise linked oligomers consisting of oligo- or polyethylene oxide and/or oligo- or propylene oxide and/or oligo- or polybutylene oxide, as well as aryl ethoxylates or alkyl-aryl ethoxylates. Polymeric natural substances such as the lignins or their alkali metal or alkaline earth metal salts can also be used as (co)-thickeners.

Sequestrants such as sodium diphosphonate, which are useful for example for removing tea stains, can likewise be added to the agent. Dispersants, which, for example, hold Ca or Mg salts in suspension in the wash liquor, can also be present as a constituent in the agent. Moreover, the agent can also comprise complexing agents such as, for example, phosphonates or EDTA.

Furthermore, hydrophobicizers such as, for example, Aerosil, in particular thoroughly methylated Aerosil (Carbot Carbon) can be added as fillers to the agent according to the invention.

The agent according to the invention can of course—if desired—also comprise dyes, fragrances and enzymes (amylases, lipases, proteases, cellulases and peroxidases).

In order to bind unpleasant odors, the agent can furthermore comprise odor binders (malodor counteractants), which are preferably added to the fragrances. Such odor binders are described for example in U.S. Pat. No. 7,288,507 B2.

The viscosity of the agent can be adjusted depending on the desired intended use and the type of application.

The viscosity of the agent should, on the one hand, be so low that the agent can effectively wet the stain to be treated. On the other hand, the viscosity of the agent should in turn be sufficiently high that it does not "run off" again from the stain to be treated or the contaminant and the applied amount can be dosed.

Depending on the intended use, the agents can be of low to high viscosity, depending on what type of surface or fabric they are to be applied and adhere over an extended time.

The agent according to the invention is preferably pasty. In a particularly preferred embodiment, the agent has a viscosity of at least 30 Pa*s, in particular at least 100 Pa*s, measured using a Haake viscometer, plate/plate system, plate diameter 10 mm, with a shear gradient of 2.62 $s^{-1}$ and 20° C. Such a paste can be spread onto the surface to be treated for example using a brush or a spatula, where it adheres.

The stain remover according to the invention is applied to the area to be cleaned of the article to be treated, in particular textiles, on the stain or in the armpit area using brushes. The stain remover adheres and, in the presence of water, then slowly releases, in the alkaline wash liquor, the active ingredients which gradually dissolve the stain.

In the case of the acidic stain remover for the armpit area of textiles, the residue of sparingly soluble aluminum salts is slowly broken down, in the presence of water, by the released acid without attacking the textile fibers. Here, the local medium around the stain is acidic but the entire remainder of the textiles is in an alkaline solution.

The agent according to the invention is generally suitable for removing stains from textiles of plant, animal or synthetic origin. In particular, the agent is suitable for removing deposits of deodorant with perspiration on cotton textiles.

For the removal of stains from textiles, the stain remover according to the invention is firstly applied to the stain to be removed, where it adheres.

Then, the applied stain remover is removed again, for example by washing the treated item of clothing after a certain action time of at least one minute in the washing machine or else also by hand.

As a result of the washing, the water-soluble active substance, i.e. the alkalis or the bleach, is released locally in the area around the stain and the stain is removed. Predominantly the wash liquor or—if no washing takes place in the washing machine with a detergent—water acts on the remaining "unstained" in particular textile material.

Since the active ingredient, if water-soluble, such as acids, alkalis or bleaches, is released from the agent only upon contact with water, damage to the fabric—in contrast to the agents known hitherto—arising due to the stain remover being applied but then not rinsed off again within the required time is virtually excluded.

As a result of the contact with water, the stain remover, also as a consequence of the surfactants present in the agent, is removed again completely from the surface.

Besides the removal of perspiration stains, the agent according to the invention can also be used for removing blood, rust and iron stains or other acid-soluble stains.

In a variant with at least 5% by weight of an acid and/or at least 1% by weight of a biocide as active substance, the agent according to the invention can also be used for removing moss and other deposits, for example on stones.

The biocide that can be used is, for example, benzalkonium chloride, bronopol, glutaraldehyde, formaldehyde, triazine, dibromonitrilepropionamide, perbutryn, IPBC, OIT and diuron.

In a variant with the alkali ammonium hydroxide or dilute organic or inorganic acids, the agent can also be used for removing contaminants from copper or other metals on hard surfaces such as, for example, from printed circuit boards.

The stain remover according to the invention is preferably applied at room temperature to the article to be treated and then rinsed off again with cold or warm water.

The agent according to the invention is particularly suitable for one-off use for removing stains and contaminants, where the entire agent is then removed again with water following the application.

In order to protect water-soluble active ingredients in the agent against premature decomposition and to ensure that the active ingredients in the agent, if water-soluble, are only released upon washing or flushing with water, the agent should preferably be anhydrous or else have a water fraction of at most 5% by weight and particularly preferably at most 1% by weight.

The invention will be described in more detail below by reference to working examples.

Shown below are a guide formulation and an example formulation of an acidic agent according to the invention which can serve for example for the removal of stains on textiles in the armpit area.

I. Guide Formulation for an Acid-Adjusted Agent

| | Range | Preferred range |
|---|---|---|
| Polymer (opt. dissolved in mineral oil) | 0.5 to 50% (based on the polymer) | 15 to 20% Versagel (i.e. styrene copolymer, dissolved in mineral oil) |
| Surfactants | 5 to 60% | 10 to 50% |
| Solubility promoter | 0 to 30% | 10 to 20% |
| Acid(s) | 10 to 50% | 20 to 40% |
| Humectant | 0 to 30% | to 15% |

II. Formulation of an Acidic Agent for Removing Stains in the Armpit Area ("Armpit Cleaner")

The agent based on the formulation below is referred to hereinbelow as "armpit cleaner":

| | |
|---|---|
| Versagel 1600 (styrene copolymer dissolved in mineral oil) | 15% |
| Surfactants | |
| Lutensol A05 (C13/C15-oxo alcohol ethoxylate/5 EO, BASF) | 5% |
| Lutensol A08 (C13/C15-oxo alcohol ethoxylate/8 EO, BASF) | 15% |
| Texapon SPN 70 (sodium lauryl ether sulfate, Cognis) | 5% |
| Solubility promoter Eltesol SCS93 (cumene sulfonate, Na salt, Rhodia) | 15% |
| Acid | |
| Amidosulfonic acid | 30% |
| Phosphoric acid (85%) | 5% |
| Glycerol | 10% |

III. Tests as to the Effectiveness of the Removal of Stains in the Armpit Area

The armpit cleaner according to the above formulation II was applied to stains on a blue t-shirt worn several times in the armpit area. Dr. Beckmann's Stain Devil "Rust & Deodorant" was applied to the adjacent stain in the armpit area in accordance with the instructions.

The washing conditions were as follows: 55 g of washing powder per 4.5 kg of laundry, liquor ratio 1:5, washing temperature 40° C., 250 mg/$cm^2$ armpit cleaner, action time 60 minutes, washing time 30 minutes, rinsing time 3×30 seconds, cold.

Figure 1B:
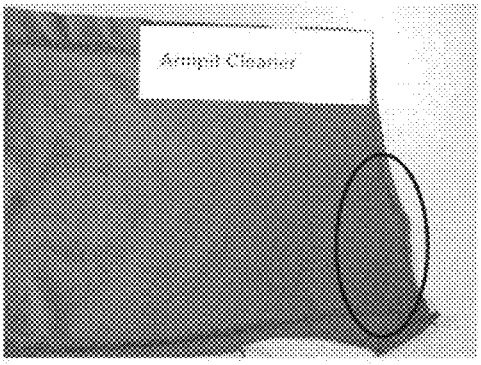
Figure 1C:
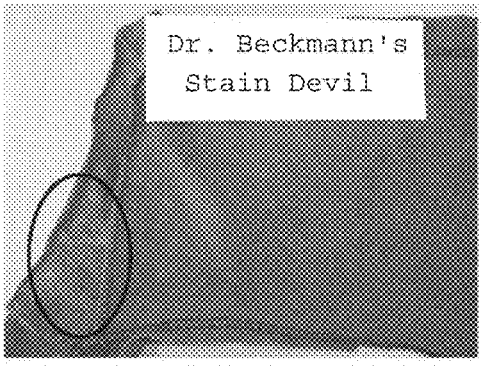

FIGS. 1(*a*) through 1(*c*) show the starting material with the stains in the armpit area and the result after removing the stain with the armpit cleaner according to the invention and with Dr. Beckmann's Stain Devil.

With the armpit cleaner according to the invention, the stain in the armpit area is removed completely, whereas upon treating the stain with Dr. Beckmann's Stain Devil, clearly visible stains remain in the armpit area.

IV. Investigation of Possible Quality Losses in Different Fabrics Due to the Armpit Cleaner According to Experiment II The German Textile Research Institute North-West (Krefeld) investigated the effect of the agent for removing stains in the armpit area from experiment II on the following fabrics:

a) Investigated Fabric

| TM | Sample name | Material (%) | Shade |
|---|---|---|---|
| 1 | Cotton silky sheen (4000361010017) | CO (100) | White |
| 2 | Cotton silky sheen (4000364014404) | CO (100) | Green |
| 3 | Cotton light (2000000059396) | PES/CO (65/35) | White |
| 4 | Cotton light (2000000059488) | PES/CO (65/35) | Yellow |
| 5 | Item of clothing stretch (2000000061764) | PES/CV/EL (65/32/3) | White |
| 6 | Item of clothing stretch (2000000061757) | PES/CV/EL (65/32/3) | Cherry |
| 7 | Microfiber peach (2000000032051) | PES (100) | white |
| 8 | Microfiber peach (2000000062099) | PES (100) | Red |
| 9 | Lycra dance clothing (4000302010017) | PA/EL (80/20) | White |
| 10 | Lycra dance clothing (4000302011403) | PA/EL (80/20) | Orange |

TM = number of the test material;
Supplier of the investigated fabric: www.Stoff4you.de
CA = acetate,
CO = cotton,
PA = polyamide,
PAN = polyacrylic,
PES = polyester,
WO = wool,
CV = viscose,
EL = Lycra;
*optically lightened In the course of the investigations, a spreader was used to apply approx. 50 mg/cm$^2$ of the armpit cleaner according to formulation II to each sample.

b) Test Methods for the Determination of Colorfastness:

The colorfastness for domestic laundry and commercial laundry was determined in accordance with DIN EN ISO 105-C06 (Linitest plus), A1S, 40° C., with steel balls, publication date: 2010-08, multifiber ballast fabric type "DW" and ECE detergent with phosphate.

Evaluation: fastness value—1—(poor) to—5—(good)

c) The Untreated Fabric Samples Produced the Following Results:

TABLE 1

| | Change in | Bleeding from | | | | | |
|---|---|---|---|---|---|---|---|
| TM | color | WO | PAN | PES | PA | CO | CA |
| 1 | -5- | -5- | -5- | -5- | -5- | -5- | -5- |
| 2 | 4-5 | -5- | -5- | -5- | -5- | -3- | -5- |
| 3 | -5- | -5- | -5- | -5- | -5- | 4-5* | -5- |
| 4 | -5- | -5- | -5- | -5- | -4- | -5- | 4-5 |

TABLE 1-continued

| | Change in | Bleeding from | | | | | |
|---|---|---|---|---|---|---|---|
| TM | color | WO | PAN | PES | PA | CO | CA |
| 5 | -5- | -5- | -5- | -5- | -5- | -5- | -5- |
| 6 | -5- | -3- | 4-5 | -3- | -3- | -3- | -3- |
| 7 | -5- | -5- | -5- | -5- | -5- | -5- | -5- |
| 8 | -5- | 4-5 | -5- | 4-5 | 3-4 | 4-5 | 4-5 |
| 9 | -5- | -5- | -5- | -5- | -5- | -5- | -5- |
| 10 | -5- | -5- | -5- | -5- | -5- | -5- | -5- |

CA = acetate,
CO = cotton,
PA = polyamide,
PAN = polyacrylic,
PES = polyester,
WO = wool,
*optically lightened d) The Fabric Samples with Armpit Cleaner (Action of the Paste: 50 mg/cm$^2$ and 60 Minutes) Produced the Following Results:

TABLE 2

| | Change in | Bleeding from | | | | | |
|---|---|---|---|---|---|---|---|
| TM | color | WO | PAN | PES | PA | CO | CA |
| 1 | -5- | -5- | -5- | -5- | -5- | -5- | -5- |
| 2 | 4-5 | -4- | 4-5 | 4-5 | -3- | -3- | 4-5 |
| 3 | -5- | -5- | -5- | -5- | -5- | 4-5* | -5- |
| 4 | -5- | -5- | -5- | -5- | -5- | 4-5 | -5- |
| 5 | -5- | -5- | -5- | -5- | -5- | -5- | -5- |
| 6 | -5- | -2- | -4- | -3- | -2- | -2- | -3- |
| 7 | -5- | -5- | -5- | -5- | -5- | -5- | -5- |
| 8 | -5- | 4-5 | -5- | 4-5 | 4-5 | 4-5 | 4-5 |
| 9 | -5- | -5- | -5- | -5- | -5- | -5- | -5- |
| 10 | -5- | -5- | -5- | -5- | -5- | -5- | -5- |

CA = acetate,
CO = cotton,
PA = polyamide,
PAN = polyacrylic,
PES = polyester,
WO = wool,
*optically lightened V. Washing Experiment in Domestic Washing Machine The respective test material was washed in accordance with DIN EN ISO 6330 in a domestic washing machine, on the one hand untreated, without paste and on the other hand with armpit cleaner. For this, 50 mg/cm$^2$ of the armpit cleaner paste was applied centrally in a strip approx. 3 cm in width using a blade and left to act for 60 minutes.

The washing was carried out at a washing temperature of 40° C., standard wash,

Detergent: mild detergent,

Load: 2 kg,

Washing machine model: Miele "Gala Grande".

In order to prevent contamination by another test material, each test material was washed separately. The samples obtained in this way formed the basis for the further tests.

The tensile properties of the fabrics were determined in accordance with DIN EN ISO 13934-1, determination of maximum force and elongation at maximum force using the strip method, publication date: 1999-04 with clamp length 200 mm, strip width: 50 mm, test rate (warp) 100 mm/min, test rate (weft): 100 mm/min, pretension 2 N.

Condition of the sample: aligned, standard climatic conditions: 20° C., 65% relative atmospheric humidity Number of measurement samples: 3 in each direction a) Original—Blank Sample:

TABLE 3

| TM | Fabric direction | Maximum force [N] | Elongation at maximum force [%] |
|---|---|---|---|
| 2 | Warp | 415 ± 9.04 | 7.5 ± 0.2 |
| | Weft | 447 ± 7.52 | 20.8 ± 0.2 |
| 4 | Warp | 934 ± 30.8 | 21.4 ± 0.1 |
| | Weft | 539 ± 16.2 | 19.5 ± 0.3 |
| 6 | Warp | 901 ± 22.2 | 60.0 ± 2.0 |
| | Weft | 647 ± 22.4 | 58.5 ± 3.0 |
| 8 | Warp | 748 ± 2.3 | 48.5 ± 2.3 |
| | Weft | 599 ± 4.45 | 27.2 ± 2.3 |

b) Washed:

TABLE 4

| TM | Fabric direction | Maximum force [N] | Elongation at maximum force [%] |
|---|---|---|---|
| 2 | Warp | 330 ± 19.7 | 18.8 ± 0.8 |
| | Weft | 326 ± 3.78 | 26.8 ± 1.0 |
| 4 | Warp | 841 ± 23.4 | 22.4 ± 0.6 |
| | Weft | 552 ± 15.2 | 22.6 ± 0.3 |
| 6 | Warp | 1060 ± 27.9 | 55.2 ± 1.5 |
| | Weft | 989 ± 20.6 | 92.1 ± 6.1 |
| 8 | Warp | 820 ± 3.94 | 49.3 ± 1.7 |
| | Weft | 708 ± 11.7 | 23.4 ± 0.4 |

c) With Armpit Cleaner (Action of the Paste: 50 mg/cm$^2$ and 60 Minutes) and Washed:

TABLE 5

| TM | Fabric direction | Maximum force [N] | Elongation at maximum force [%] |
|---|---|---|---|
| 2 | Warp | 451 ± 24.5 | 14.7 ± 1.2 |
| | Weft | 445 ± 5.21 | 21.9 ± 0.3 |
| 4 | Warp | 822 ± 23.0 | 21.2 ± 1.0 |
| | Weft | 510 ± 11.4 | 21.3 ± 0.2 |
| 6 | Warp | 1170 ± 30.0 | 47.4 ± 0.4 |
| | Weft | 1180 ± 5.68 | 61.0 ± 1.9 |
| 8 | Warp | 844 ± 0.88 | 47.5 ± 0.8 |
| | Weft | 727 ± 159 | 22.2 ± 1.2 |

VI. Determination of the Tensile Properties

The tensile properties of the fabrics were determined in accordance with DIN EN ISO 13934-2, determination of maximum force using the grab method: publication date: 1999-04.

a) Original—Blank Sample

TABLE 6

| TM | Fabric direction | Maximum force [N] | Elongation at maximum force [%] |
|---|---|---|---|
| 10 | Longitudinal | 224 ± 9.73 | 139.2 ± 1.3 |
| | Transverse | 312 ± 9.62 | 99.2 ± 2.3 |

b) Washed

TABLE 7

| TM | Fabric direction | Maximum force [N] | Elongation at maximum force [%] |
|---|---|---|---|
| 10 | Longitudinal | 218 ± 10.8 | 135.1 ± 3.1 |
| | Transverse | 319 ± 7.38 | 95.4 ± 2.5 |

c) With Armpit Cleaner (Action of the Paste: 50 mg/cm$^2$ and 60 Minutes) and Washed:

TABLE 8

| TM | Fabric direction | Maximum force [N] | Elongation at maximum force [%] |
|---|---|---|---|
| 10 | Longitudinal | 219 ± 13.2 | 129.0 ± 2.1 |
| | Transverse | 290 ± 19.3 | 82.8 ± 3.3 |

VII. Coatings and Attendant Materials

In accordance with DIN 54278-1, determination of the substances soluble in organic solvents, Publication date: 1995-10

Solvent: water

Original—Blank Sample:

TABLE 9

| TM | Dissolved substance [%] | | |
|---|---|---|---|
| | Individual values | | Average value |
| 1 | 1.23 | 1.10 | 1.17 |
| 3 | 0.68 | 0.72 | 0.70 |
| 5 | 0.17 | 0.20 | 0.19 |
| 7 | 0.17 | 0.17 | 0.17 |
| 9 | 0.19 | 0.17 | 0.18 |

I) Washed:

TABLE 10

| TM | Dissolved substance [%] | | |
|---|---|---|---|
| | Individual values | | Average value |
| 1 | 0.32 | 0.29 | 0.31 |
| 3 | 0.92 | 0.79 | 0.86 |
| 5 | 0.28 | 0.21 | 0.24 |
| 7 | 0.14 | 0.15 | 0.15 |
| 9 | 0.40 | 0.27 | 0.33 |

II) With TM 11 (Action of the Paste: 50 mg/cm$^2$ and 60 Minutes) and Washed:

TABLE 11

| TM | Dissolved substance [%] | | |
|---|---|---|---|
| | Individual values | | Average value |
| 1 | 0.40 | 0.47 | 0.44 |
| 3 | 1.52 | 1.51 | 1.52 |
| 5 | 0.29 | 0.27 | 0.28 |
| 7 | 0.30 | 0.28 | 0.29 |
| 9 | 0.75 | 0.77 | 0.76 |

VIII. Result

Under the described experimental conditions, neither a yellowing of the various substrates (TM 1m, TM 3, TM 5, TM 7 and TM 9), nor a change in shade of the colored samples was established as a result of the treatment with armpit cleaner. For two samples, a relatively strong bleeding of the ballast fabric was established upon rinsing out the armpit cleaner (TM 2 and TM 6) (cf. Table 2).

Moreover, no noteworthy impairment of the maximum force of the various substrates as a result of using armpit cleaner was recorded (see Table 3 to Table 8).

The ability of the applied amount of armpit cleaner to be washed out by domestic washing with the program "Delicates" at 40° C. proves to be good for the stretch and the microfiber material (TM 5 and TM 7). However, for the polyester/cotton material (TM 3) and the lycra material (TM 9), higher residual deposits were ascertained, i.e. the ability to be washed out under the experimental conditions proves to be somewhat poorer (see Table 9 to Table 11).

The result established is that as a result of using armpit cleaner under the aforementioned experimental conditions no yellowing or changes in shade of the tested textiles has arisen. Similarly, no negative influence on the material strengths was ascertained.

IX. Formulation of an Agent with Alkali and Hydrophobic Solvents as Active Substance for Removing Grease, Wax and Lipstick The formulation below is suitable in particular for removing the above stains on soft surfaces such as textiles.

| | % by weight |
|---|---|
| Versagel M 1600 | 15 |
| Lutensol TO3 (C13-oxo alcohol/3 EO, BASF) | 5 |
| Lutensol AO 5 (C13/C15-oxo alcohol ethoxylate/5 EO, BASF) | 5 |
| Lutensol AO 8 (C13/C15-oxo alcohol ethoxylate/8 EO, BASF) | 15 |
| Eltesol SCS 93 (cumenesulfonate, Na salt, Rhodia) | 15 |
| Sokalan PA30 CL (polyacrylate, BASF) | 0.5 |
| Orange terpenes | 30 |
| Glycerol (85%) | 5 |
| NaOH | 5 |
| Texapon SPN 70 (sodium lauryl ether sulfate, Cognis) | 4.5 |
| Total | 100 |

The NaOH present in the agent acts as a grease dissolver and brings about swelling of the fibers such that the constituents are better able to reach the fibers and be transported away from these again.

The mixture of short-chain, oil-soluble surfactants (Lutensol TO3 and Lutensol AO 5) and longer-chain water-soluble surfactants and the solubility promoter Eltesol lead to the contamination passing into the aqueous phase.

X. Formulation for an Acidic Bleaching Stain Remover, for Example for Removing Red Wine Stains from Textiles To remove stains with oxidative constituents such as, for example, dyes, the following acidic agent can be used:

| | % by weight |
|---|---|
| Kelzan ASX (Xanthan Gum, Monsanto) | 1.86 |
| Eltesol | 6.5 |
| Tensopol USP94 (lauryl C12-16-sulfate Na salt, Manro) | 31.64 |
| Versagel M 1600 | 40 |
| Sodium perborate | 15 |
| TAED | 5 |
| Total | 100 |

This formulation comprises sodium perborate as bleach and TAED as oxidation activator.

XI. Further Washing Experiments with the Agents According to the Invention

In order to test the effectiveness of the agents according to the invention, further washing experiments were carried out with material with different soilings under laboratory conditions, and by washing in a domestic washing machine and compared with Dr. Beckmann's Stain Devil.

The washing results are discussed in detail below.

a) Shoe Cream Stains

Figure 2A:
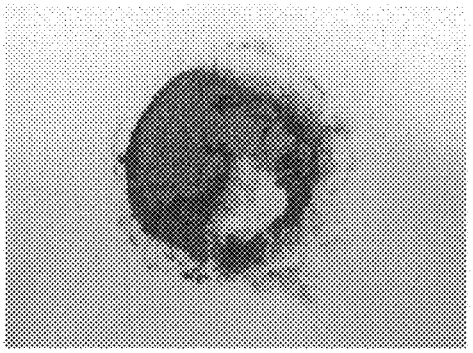
FIGS. 2(*a*) through 2(*c*) are photos, as discussed in Example XI, part (*a*), showing a starting material with a shoe cream stain, the result after treating such a stain with an agent according to the invention, and the result after treating such a stain with Dr. Beckmann's Stain Devil, respectively.
Figure 2B:
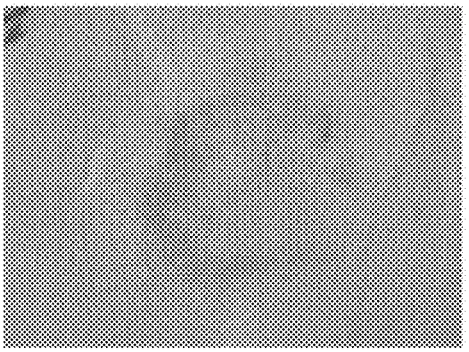
Figure 2C:
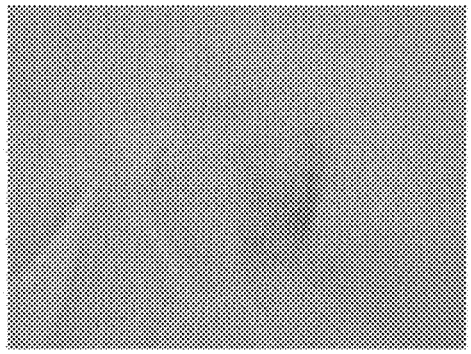

The comparison of the stain removal of shoe cream with the agent according to the invention according to formulation IX (alkali with terpenes) and Dr. Beckmann's Stain Devil "Lubricants/oils" is shown after a single treatment in FIGS. 2(*a*) through 2(*c*).

The results show that using the agent according to the invention according to formulation IX, at least as good a stain removal is achieved as with Dr. Beckmann's Stain Devil, both under laboratory conditions and also during household washing.

b) Choco Cream Stains

Figure 3A:
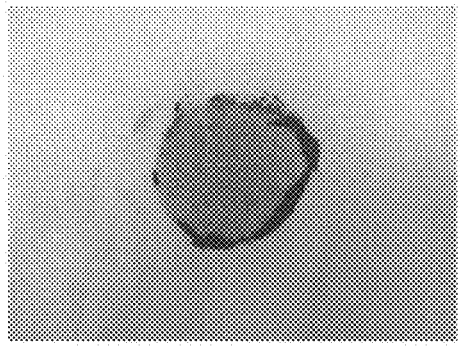
FIGS. 3(*a*) through 3(*c*) are photos, as discussed in Example XI, part (*b*), showing a starting material with a choco cream stain, the result after treating such a stain with an agent according to the invention, and the result after treating such a stain with Dr. Beckmann's Stain Devil, respectively.
Figure 3B:
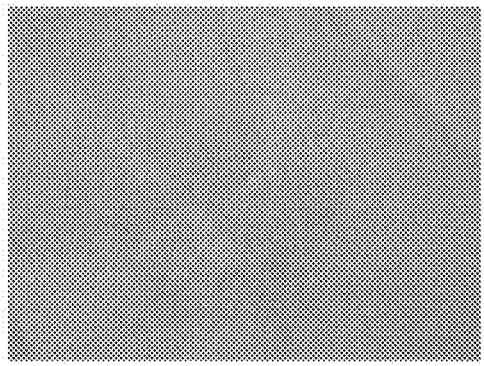
Figure 3C:
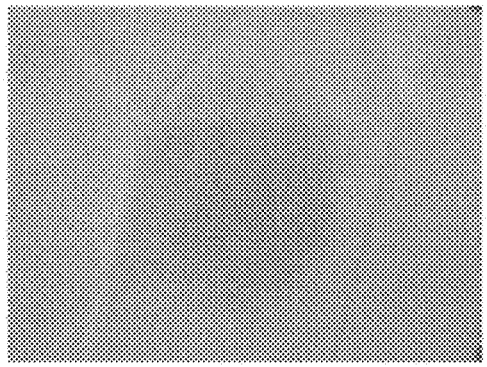

The removal of choco cream stains using the agent according to the invention in accordance with formulation IX (alkali and terpenes) and Dr. Beckmann's Stain Devil "Grease and sauces" is shown in FIGS. 3(*a*) through 3(*c*). After a single application, only a slight "shadow" can be made out in the case of the agent according to the invention, whereas following removal with Dr. Beckmann's Stain Devil the stain is still clearly visible.

c) Red Wine Stains

Figure 4A:
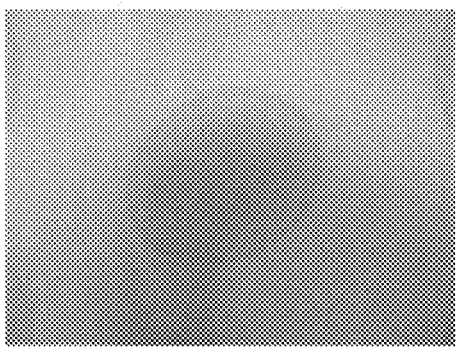
FIGS. 4(*a*) through 4(*c*) are photos, as discussed in Example XI, part (*c*), showing a starting material with a red wine stain, the result after treating such a stain with an agent according to the invention, and the result after treating such a stain with Dr. Beckmann's Stain Devil, respectively.
Figure 4B:
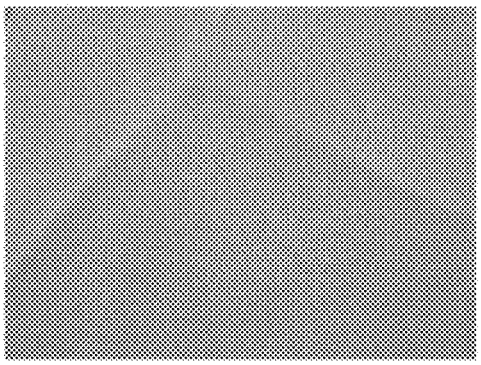
Figure 4C:
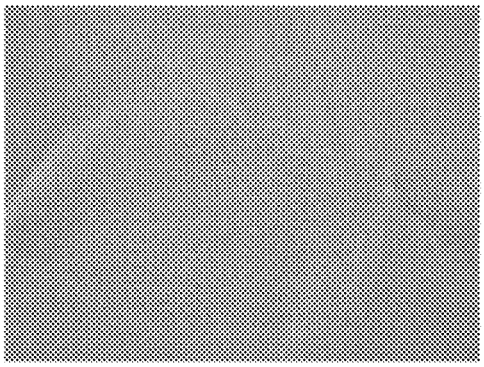

FIGS. 4(*a*) through 4(*c*) show the removal of red wine stains using the agent according to the invention in accordance with formulation X and, for comparison, with Dr. Beckmann's Stain Devil "Fruit & drinks". The figures show that the stain with the agent according to formulation X compared to Dr. Beckmann's Stain Devil is completely removed after just a single treatment.

d) Lipstick Stains

Figure 5A:
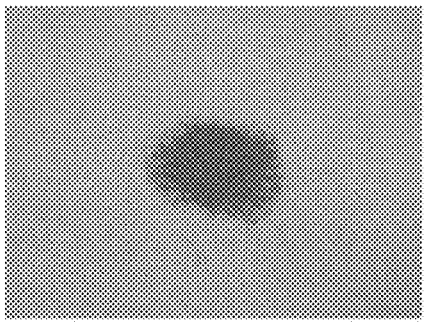
FIGS. 5(*a*) through 5(*c*) are photos, as discussed in Example XI, part (*d*), showing a starting material with a lipstick stain, the result after treating such a stain with an agent according to the invention, and the result after treating such a stain with Dr. Beckmann's Stain Devil, respectively.
Figure 5B:
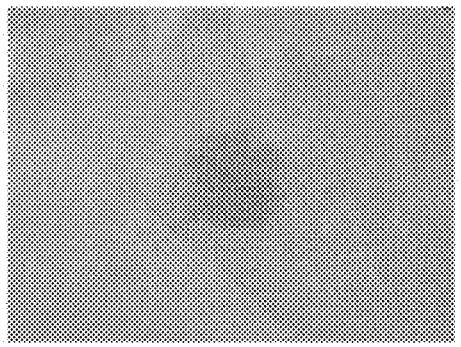
Figure 5C:
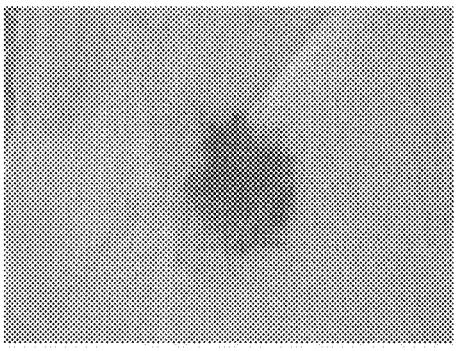

The removal of lipstick stains is generally very difficult. Compared with Dr. Beckmann's Stain Devil "Nature & beauty", however, the agent according to the invention in accordance with formulation IX exhibits visibly better results than the Stain Devil (FIGS. 5(*a*) through 5(*c*)), under laboratory conditions and also in domestic washing.

e) Turmeric Stains

Figure 6A:
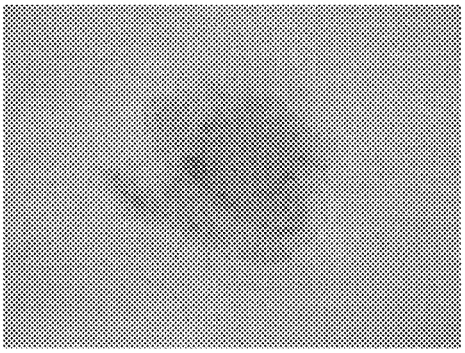
FIGS. 6(*a*) through 6(*c*) are photos, as discussed in Example XI, part (*e*), showing a starting material with a tumeric stain, the result after treating such a stain with an agent according to the invention, and the result after treating such a stain with Dr. Beckmann's Stain Devil, respectively.
Figure 6B:
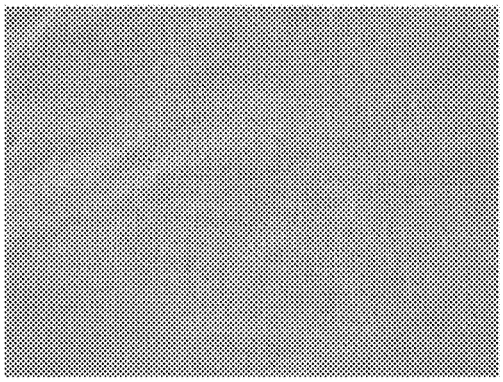
Figure 6C:
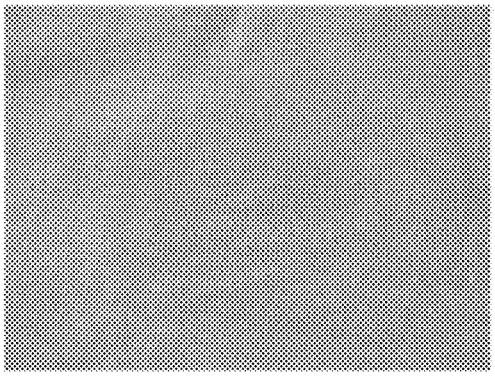

In the case of the removability of turmeric or curry, the stain remover according to the invention in accordance with formulation IX results in more extensive removal of the stain after just the first wash and to better stain removal than with Dr. Beckmann's Stain Devil "Grease & sauces" likewise tested for comparison. The comparative experiment is shown in FIGS. 6(*a*) through 6(*c*).

XII. Washing Conditions

The stain paste according to the invention is applied evenly to the stain using the spatula. The action time is 15 to 30 minutes. Dr. Beckmann's Stain Devil is applied in accordance with instructions.

a) Laboratory: Beaker Washing

Under laboratory conditions, the washing was carried out as follows in the concentration ratio: 55 g of washing powder per 4.5 kg of laundry, liquor ratio 1:5, wash temperature 40° C., ballast washing (Terry cotton).

The wash time was 30 minutes and the rinsing time with cold water 3×30 seconds.

b) Household Washing

The washing process in a washing machine, wash program 40° C. without prewash.

The invention claimed is:

1. An agent for removing stains or deposits from hard or soft surfaces, which agent comprises:

a) from 25% by weight to 45% by weight surfactants;

b) an adhesion promoter which is a diblock or triblock alkylene styrene copolymer selected from the group consisting of styrene-butadiene-styrene copolymers (SBS), the styrene-isoprene-styrene copolymer (SIS), the styrene-ethylene/butylene-styrene copolymers (S-EB-S), the styrene-ethylene/propylene copolymers (S-EP), the styrene-ethylene/butylene copolymers (S-EB), the styrene-butadiene copolymers (SB) and styrene-isoprene copolymers (SI), wherein the alkylene styrene copolymers may also be hydrogenated or partially hydrogenated; and c) an active substance selected from the group consisting of:

1) at least 10% by weight of at least one acid;

2) at least 10% by weight of at least one alkali;

3) at least 5% by weight of a bleach; and 4) at least 10% by weight of hydrophobic organic solvent not bonded in a gel, and mixtures thereof, wherein the agent has a water fraction of at most 5% by weight.

2. The agent as claimed in claim 1, characterized in that the pH of a 1% solution of an acid-comprising agent is pH 2 or less.

3. The agent as claimed in claim 1, characterized in that the pH of a 1% solution of an alkali-comprising agent is at least pH 9.

4. The agent as claimed in claim 1, characterized in that the agent is pasty and has a viscosity of at least 30 Pa*s measured using a Haake viscometer, plate/plate system, plate diameter 10 mm, with a shear gradient of 2.62 $s^{-1}$ and 20° C.

5. A method of removing stains from textiles in the armpit area or stains of blood, rust and soilings on top of calcifications, the method comprising applying to the stains the agent as claimed in claim 1, wherein the agent comprises at least 10% by weight of acid.

6. A method of removing deposits containing resin, oil, soot or grease from hard surfaces and/or for the etching of surfaces, the method comprising applying to the surfaces the agent as claimed in claim 1, wherein the agent comprises at least 50% by weight of alkalis.

7. A method of removing stains of cocoa/chocolate, shoe cream, lipstick, chewing gum, turmeric or other grease- or pigment-containing stains, the method comprising applying to the stains the agent as claimed in claim 1, wherein the agent comprises at least 10% of at least one alkali and at least 10% by weight of hydrophobic organic solvents.

8. A method of removing colored stains and red wine stains, the method comprising applying to the stains the agent as claimed in claim 1, wherein the agent comprises at least 10% by weight of a bleach.

9. A method of removing moss, the method comprising applying to the moss an agent as claimed in claim 1.

10. The agent as claimed in claim 1, characterized in that the pH of a 1% solution of an acid-comprising agent is at most pH 1.5.

11. The agent as claimed in claim 1, characterized in that the pH of a 1% solution of an acid-comprising agent is at most pH 1.

12. The agent as claimed in claim 1, characterized in that the pH of a 1% solution of an alkali-comprising agent is at least pH 10.

13. The agent as claimed in claim 1, characterized in that the pH of a 1% solution of an alkali-comprising agent is at least 11.

14. The agent as claimed in claim 1, characterized in that the agent is pasty and has a viscosity of at least 100 Pa*s measured using a Haake viscometer, plate/plate system, plate diameter 10 mm, with a shear gradient of 2.62 $s^{-1}$ and 20° C.

15. A method of removing stains from textiles in the armpit area or stains of blood, rust and soilings on top of calcifications, the method comprising applying to the stains the agent as claimed in claim 1, wherein the agent comprises at least 20% by weight of acid.

16. A method of removing stains from textiles in the armpit area or stains of blood, rust and soilings on top of calcifications, the method comprising applying to the stains the agent as claimed in claim 1, wherein the agent comprises at least 30% by weight of acid.

17. A method of removing deposits containing resin, oil, soot or grease from hard surfaces and/or for the etching of surfaces, the method comprising applying to the surfaces the agent as claimed in claim 1, wherein the agent comprises at least 60% by weight of alkalis.

18. A method of removing deposits containing resin, oil, soot or grease from hard surfaces and/or for the etching of surfaces, the method comprising applying to the surfaces the agent as claimed in claim 1, wherein the agent comprises at least 70% by weight of alkalis.

19. A method of removing colored stains and red wine stains, the method comprising applying to the stains the agent as claimed in claim 1, wherein the agent comprises at least 10% by weight of a bleach, and the bleach is a peroxo compound.

* * * * *